United States Patent [19]

Adamski, Jr.

[11] Patent Number: 4,796,552

[45] Date of Patent: Jan. 10, 1989

[54] LATCH TACKER

[75] Inventor: Maximilian Adamski, Jr., Palatine, Ill.

[73] Assignee: Union Special Corporation, Chicago, Ill.

[21] Appl. No.: 50,360

[22] Filed: May 18, 1987

[51] Int. Cl.[4] ..... D05B 65/00

[52] U.S. Cl. ..... 112/285; 112/253; 112/294; D05B/65/00

[58] Field of Search ..... 112/130, 285, 286, 287, 112/288, 253, 294, DIG. 3

[56] References Cited

U.S. PATENT DOCUMENTS 3,490,403 1/1970 Boucrauy ..... 112/288 X
4,220,105 9/1950 Palacino ..... 112/287
4,679,515 7/1987 Keeton ..... 112/288

FOREIGN PATENT DOCUMENTS 61-45797 3/1986 Japan ..... 112/288
1087600 10/1967 United Kingdom ..... 112/288

*Primary Examiner*—Wm. Carter Reynolds
*Attorney, Agent, or Firm*—Powell L. Sprunger

[57] ABSTRACT

An apparatus for positioning a chain of stitches for stitching onto material in a sewing machine having a cutting device, and a first blower for positioning the chain of stitches forwardly of the needle. The apparatus has a second blower for placing the chain in the path of the cutting device.

4 Claims, 7 Drawing Sheets

10
11
13
14
15
16
17
18
19
20
21
24
25
26
27
28

FIG. 13
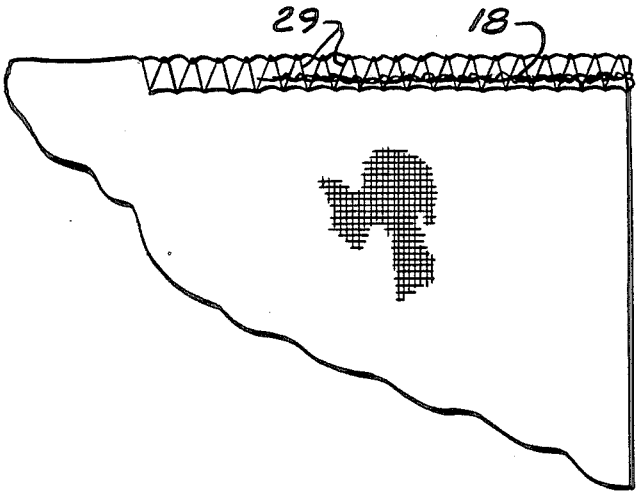
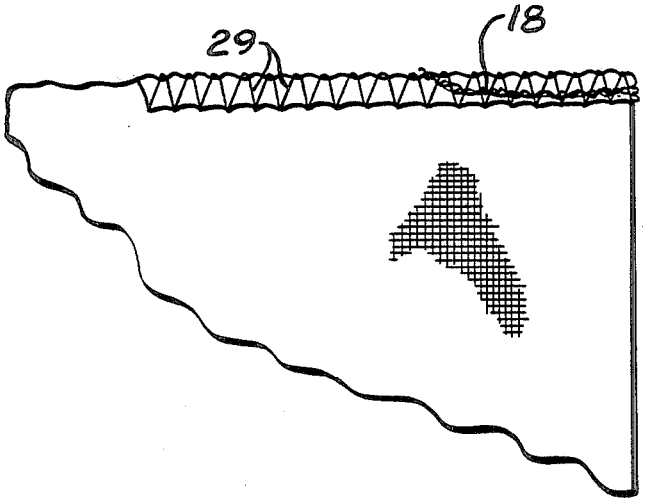
FIG. 14

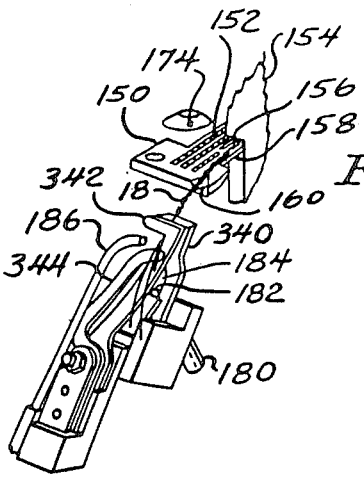
FIG. 15
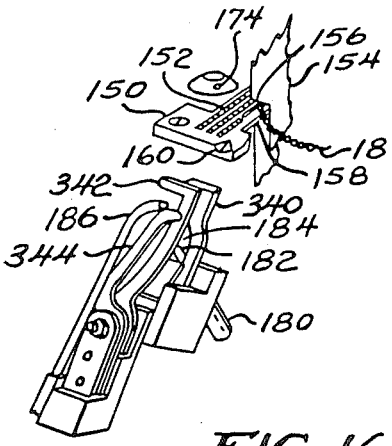
FIG. 16
FIG. 17
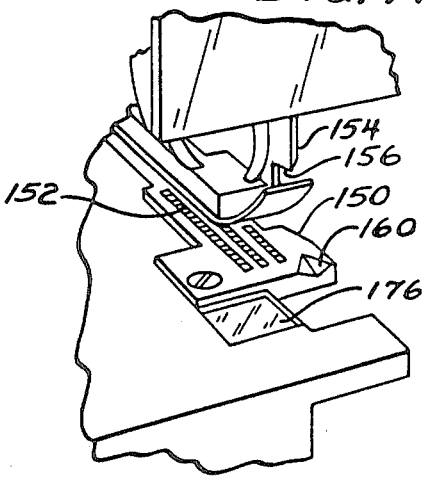
FIG. 19
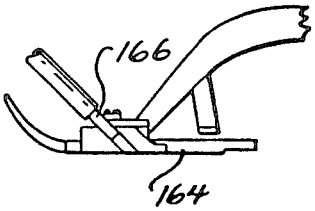
FIG. 18
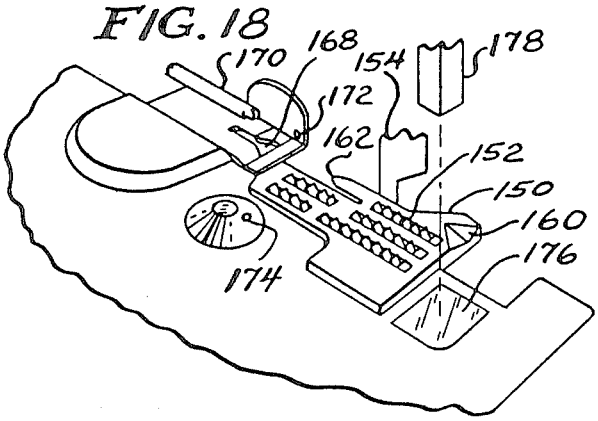

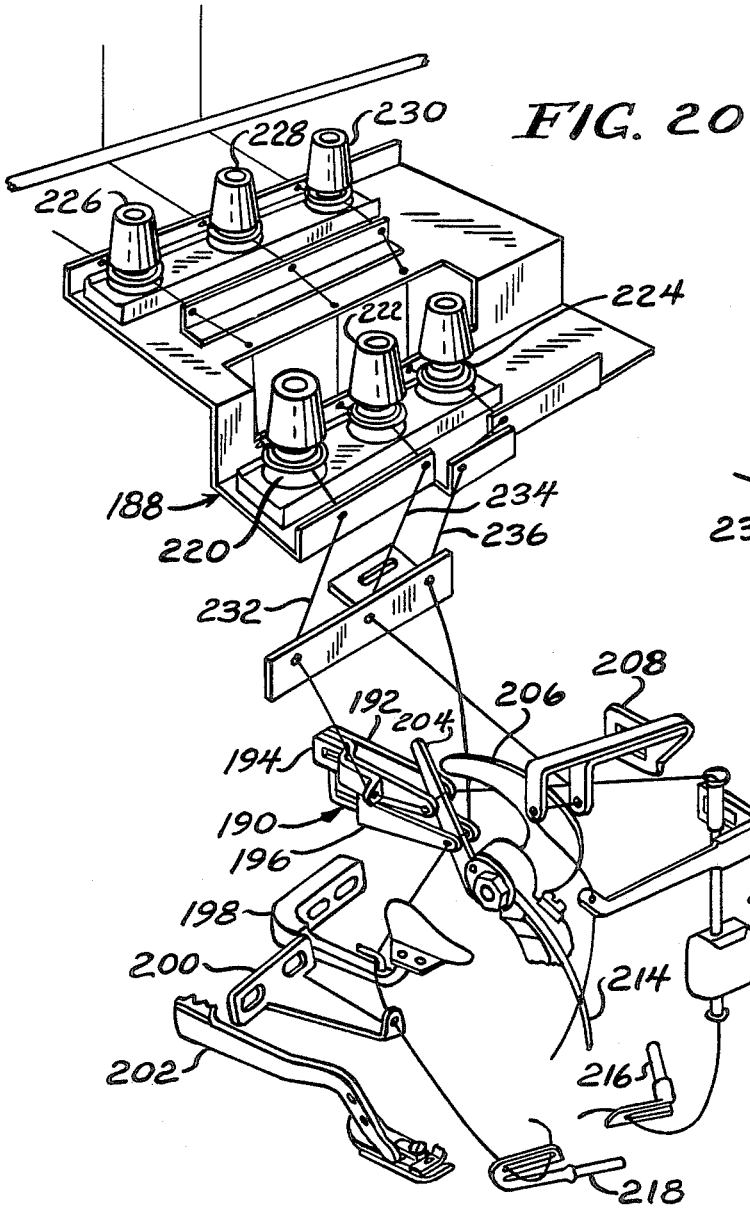
FIG. 20
FIG. 21
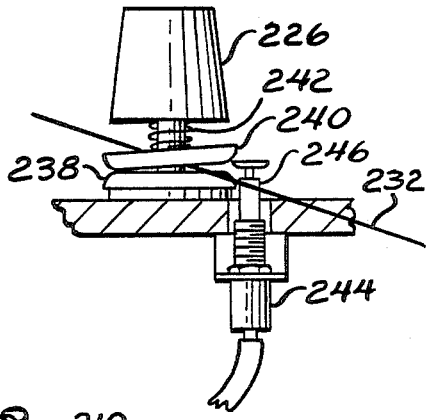
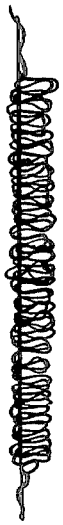
FIG. 22
FIG. 23
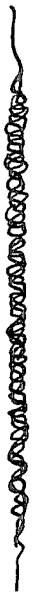

LATCH TACKER

CROSS REFERENCE TO RELATED APPLICATIONS

The present application is related to application Ser. Nos. 000,269, filed Jan. 2, 1987, and 068,587, filed June 30, 1987.

BACKGROUND OF THE INVENTION

The present invention relates to an apparatus for use with a sewing machine to cut a chain of stitches, trailing from a sewn garment and hold the cut chain in a predetermined location so as to be positioned to be incorporated into the leading portion of the seam of the next garment to be sewn.

Sewing machines that form seams utilizing chain stitches on a succession of pieces of material with the seam being continued into the area intermediate the pieces of material, are well known. With seams of this type, means are provided for detaching the pieces of material one from the other by appropriate automatic chain-cutting devices after the sewn pieces have been caused to travel beyond the needle and the presser foot of the machine.

By cutting the chain of stitches with these devices, one portion of minimal length remains attached to the stitched piece of material and the other being connected to the throat plate is manipulated to a position forwardly of the needle so that it can be incorporated into the initial portion of the seam that will be formed on the next piece of material or workpiece. This procedure prevents a slackening of the seam's initial stitches which would give the leading edge of the workpiece an undesirable appearance.

The known devices for performing this function include a chain-cutting device disposed adjacent the stitch finger of the throat plate which co-operates with a chain-orienting device and gripper apparatus located forwardly the needle and usually adjacent the forward portion of the throat plate.

These apparatii suffer from the disadvantage that, because the portion of the chain to be sewn onto the next garment is located on the upper surface of the throat plate intermediate the needle hole, the gripping apparatus is frequently accidentally displaced while positioning the next workpiece in the sewing area.

The material to be sewn interferes with the chain, preventing the proper insertion of the latter into the new seam being sewn, due to the pressure and friction of the piece of material of the chain which tend to dislodge it from the gripping apparatus and move it toward the trimmer knife of the machine that is adjacently disposed, thereby hindering subsequent handling of the chain.

A sewing machine to solve these problems is disclosed in application Ser. No. 000,269, filed Jan. 2, 1987, incorporated herein by reference. In this application, a chain of stitches is sewn into the fabric, but it is desirable to shorten the length of the chain which is sewn into the fabric.

The following patents generally relate to this subject matter: U.S. Pat. Nos. 3,490,403, 4,453,481, 4,599,960, 4,599,961, 4,303,030, 4,187,793, 4,038,933, 4,149,478, 4,220,105, 3,541,984, 3,698,336, and British application No. 2,058,858.

SUMMARY OF THE INVENTION

A principal feature of the present invention is the provision of an improved sewing machine.

According to the present invention, an apparatus is provided for positioning a chain of stitches onto material in the sewing machine having a needle and a throat plate comprising, a cutting device, means for positioning the chain of stitches forwardly of the needle, means for grasping the chain in the forward position, and means for releasing the chain from the grasping means.

A feature of the invention is the provision of means for placing the chain in the path of the cutting device.

Another feature of the invention is that the cutting device severs the chain, and results in a shorter chain sewn into the fabric.

Still another feature of the invention is that the sewn fabric has an improved appearance with the shorter chain.

Yet another feature of the invention is the provision of a tensioning device and stitch forming instrumentility which cooperate to form a loose chain of stitches on a stitch tongue of the sewing machine.

A feature of the invention is that the chain may be readily blown off the stitch tongue by a blower in a presser foot of the invention.

Further features will more fully apparent in the following description of the embodiments of this invention and from the appended claims.

DESCRIPTION OF THE DRAWINGS

In the drawings:

FIG. 13 is a fragmentary plan view of a fabric stitched with the sewing machine of the present invention;

FIG. 14 is a fragmentary plan view of a fabric stitched with the sewing machine of the present invention;

FIG. 15 is a fragmentary perspective view of another embodiment of the sewing machine of the present invention with a chain of stitches being grasped forwardly of a needle of the machine;

FIG. 16 is a fragmentary perspective view of the machine of FIG. 15 showing the chain being released and moved into the path of a cutting device;

FIG. 17 is a fragmentary perspective view of a presser foot and throat plate of the sewing machine of FIG. 15;

FIG. 18 is a fragmentary perspective view of a vacuum and blower arrangement for the sewing machine of FIG. 15;

FIG. 19 is a sectional view of the presser foot of the sewing machine;

FIG. 20 is a perspective view of a tensioning device and stitch forming instrumentility for the sewing machine of FIG. 15;

FIG. 21 is an elevational view of actuatable tensioning means for the tensioning device of FIG. 20;

FIG. 22 is a plan view of overedge stitches which are sewn into the fabric according to the present invention; and FIG. 23 is a plan view of a chain of stitches which are formed on a trailing edge of the fabric according to the present invention.

DESCRIPTION OF THE PREFERRED EMBODIMENTS

As the general construction and operation of a sewing machine, which may be of Federal Stitch Type 504, to which the present invention is applicable, is well known and familiar to those conversant in the art, and as the invention is primarily concerned with a device for positioning and gripping a chain of stitches for incorporation into the initial stitches of a new seam, it is only considered necessary here to illustrate and describe those parts which are directly concerned with a preferred form of the invention.

Figure 1:
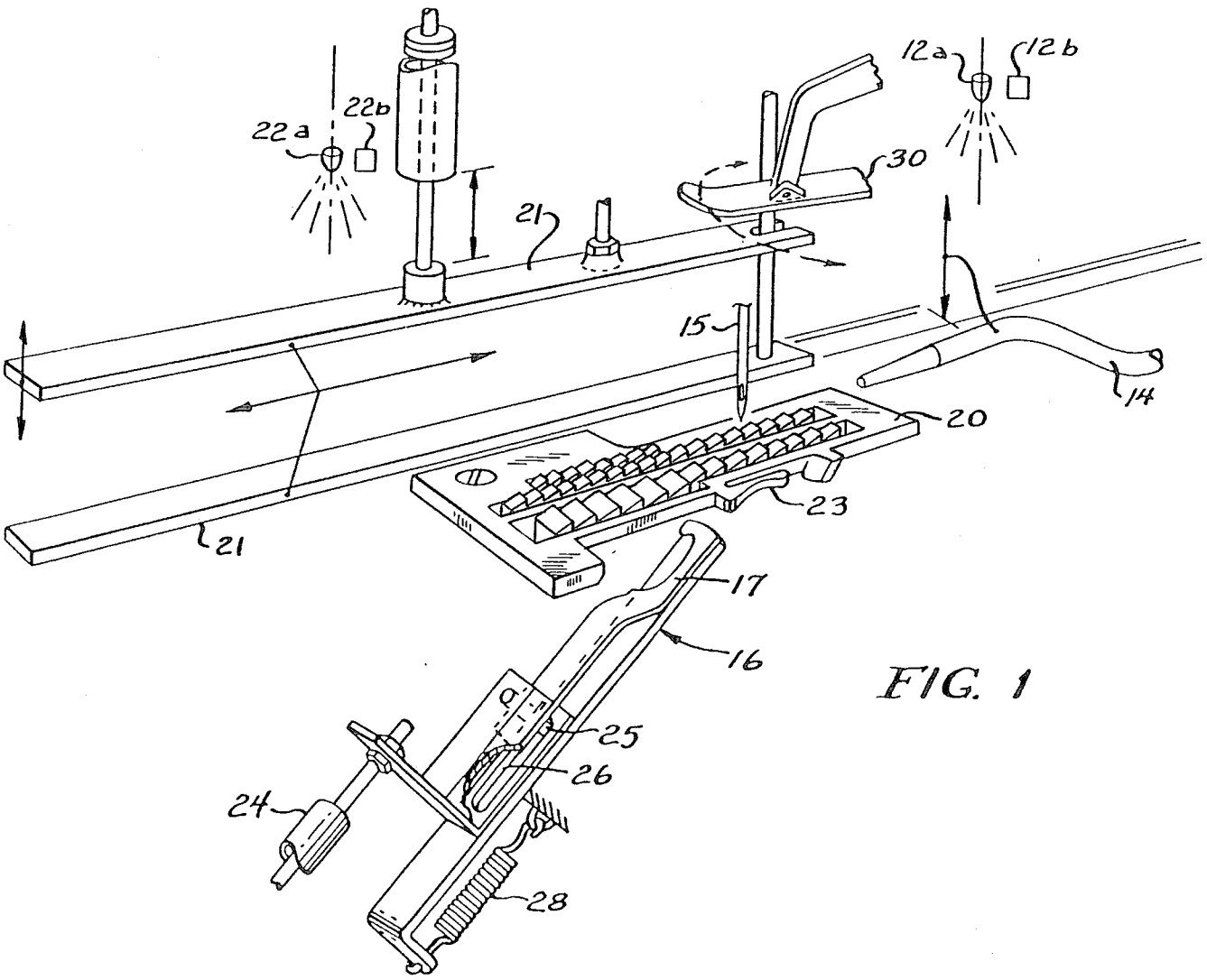
FIG. 1 is a schematic perspective view of an embodiment of a sewing machine, of the present invention.
Figures 2, 3, 4, 5:
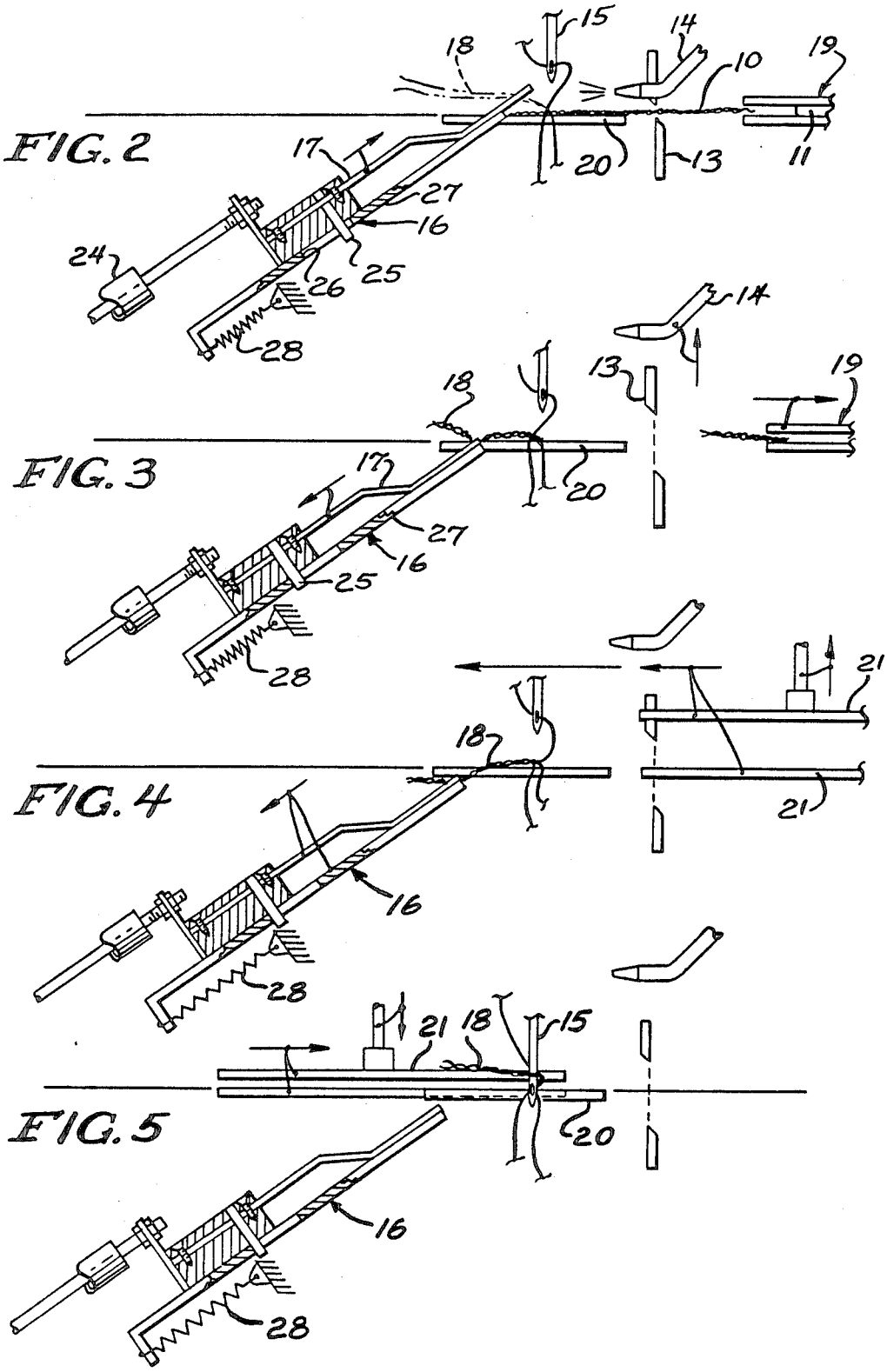
FIGS. 2–5 illustrate the cycle of operation of the machine of FIG. 1.

As shown in FIGS. 1 and 2, after the chain 10 is sewn onto the material 11, the clamp 21 moves away from the needle 15 and presser foot 30 and pulls the threads off the stitch finger or tongue 23. Light is emitted by light emitter 12*a*, and light detector 12*b* senses a change of reflectivity from a lower surface, such that the detector 12*b* senses the end of the material in response to which the cutter 13 severs the chain 10. The positioning means, in the form of a blower 14, directs a stream of air onto the severed chain to blow it back forwardly of the needle 15, as shown by the phantom chain 18. Alternatively, the machine may have a plurality of blowers to sequentially move the chain forwardly of the needle. The gripping means or apparatus 16 is activated, and the hook member 17 rises to hook around the severed chain 18.

As shown in FIG. 3, the cutter 13 opens with the material feed mechanism 19 moving the sewn material to a conveyor (not shown).

The blower 14 shuts off and is raised. The hook member 17 returns to below the throat plate 20, clamping the severed chain in the gripping means 16.

As shown in FIG. 4, the clamp 21 opens, and the released garment is removed by the conveyor, with the clamp 21 returning to its starting position forwardly of the needle 15. Meanwhile, the gripping means 16 moves further below the throat plate 20, tensioning the chain 18. Light is emitted by light emitter 22*a*, and light detector 22*b* senses a change of reflectivity from a lower surface. When material is sensed by the detector 22*b*, the clamp 21 closes and the material is fed to the sewing machine, while the chain 18 is held in tension by the gripping means 16 for the initial stitching of the seam, to prevent slackening of the seam's initial stitches which would give the leading edge of the material an undesirable appearance.

As the material 11 is moved across under the needle 15 by the material feed mechanism 19, the end of the chain is pulled from the gripping means 16 and the chain 18 is sewn into the seam, and the cycle is repeated. The resulting sewn fabric is shown in FIG. 13 in which the chain 18 is shown beneath the seaming or overedge stitches 29.

The gripping means 16 is operated by a single pneumatic cylinder 24 which is directly connected to the hook member 17. When the piston of the cylinder 24 pushes the hook member 17 upwardly, as shown in FIG. 2, an extension 25 slides in a slot 26 of member 27 of the gripping means. Upon the hook member 17 being withdrawn, as shown in FIG. 3, the extension 25 slides in the slot 26 to then abut against the member 27, whereby both the member 27 and the hook member 17 are withdrawn further below the throat plate 20 against the biasing force of the spring 28, as shown in FIG. 4. Upon the hook member 17 starting its upward motion, the spring 28 returns the member 27 to its initial position below the throat plate 20.

Thus, the present invention, at all times, provides an apparatus for the cutting and the positioning of a chain stitch which ameliorates the problems of the prior art, by providing a mechanical gripping means 16 which holds the severed chain below the level of the throat plate, with the gripping means 16 being movable between positions below and above the throat plate 20.

In an alternative form, the light emitter 12*a* and light detector 12*b* may be omitted, and a time delay may be initiated or stitches may be counted after light detector 22*b* senses the material in order to activate the cutter 13.

Figure 6:
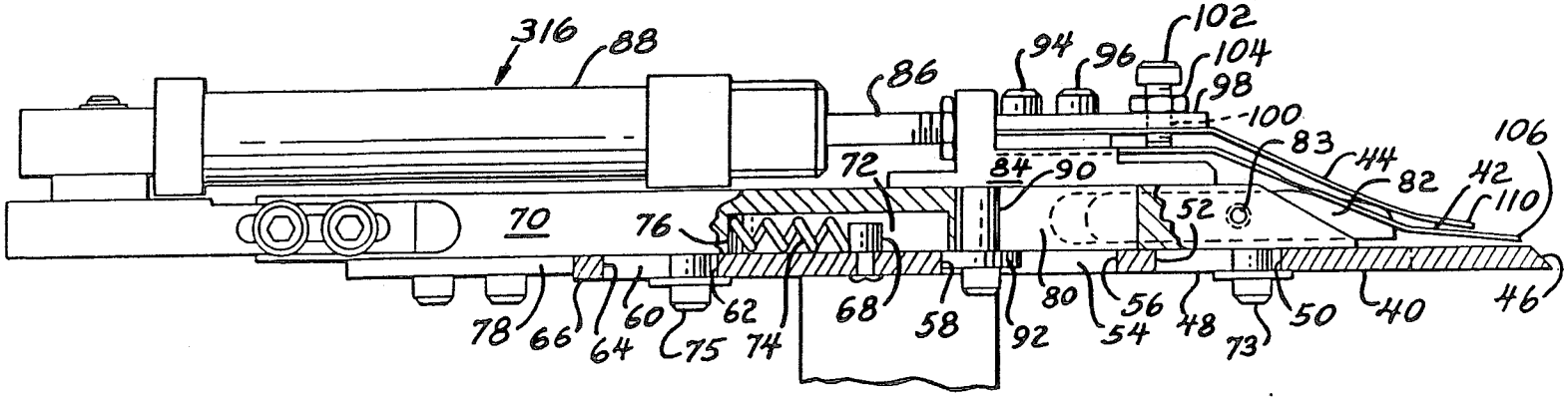
FIG. 6 is a side elevational view, partly broken away, of another embodiment of gripping apparatus for the sewing machine of FIG. 1.
Figure 7:
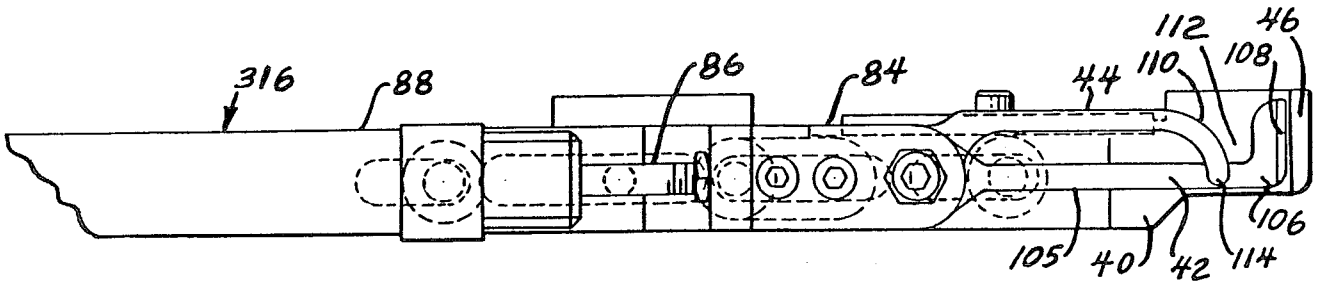
FIG. 7 is a fragmentary top plan view of the gripping apparatus of FIG. 6.
Figure 8:
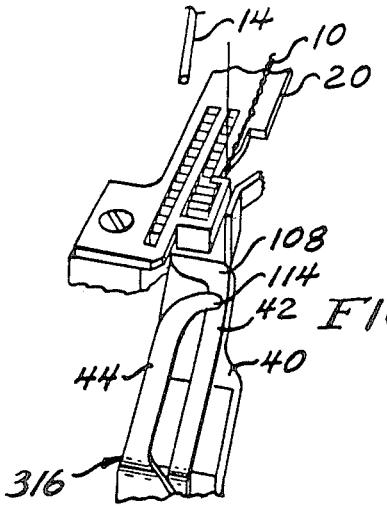
FIGS. 8–12 are fragmentary perspective views showing operation of the gripping apparatus of FIGS. 1–7.

Another embodiment of the gripping apparatus 316 is shown in FIGS. 6–12, in which like reference numerals designate like parts. With reference to FIGS. 6–8, the gripping apparatus 316 has an elongated lower plate 40, an elongated nipper 42, and an elongated guide 44.

The plate 40 has a forward beveled edge 46, a first elongated slot 48 with opposed first and second ends 50 and 52, a second elongated slot 54 with first and second ends 56 and 58, and an elongated third slot 60 with first and second ends 62 and 64. The plate 40 also has a rearward end 66. The plate 40 has an upwardly directed pin 68 for a purpose which will be described below.

The gripping apparatus 316 has a stationary member 70 having a cavity 72 facing the plate 40. A helical spring 74 is received in the cavity 72 and extends between one end 76 of the cavity 72 and the pin 68 of plate 40. In this configuration, the spring 74 is compressed and thus biases the plate 40 forwardly through the pin 68. The stationary member 70 has a rear stop 78 which bears against rearward end 66 of the plate 40 in this configuration of the gripping apparatus 316. The stationary member 70 has an elongated slot 80 extending therethrough and communicating with the second slot 54 of the plate 40. The stationary member 70 also has a forwardly directed cam 82 for a purpose which will be described below. The cam 82 is slidable in the stationary member 70, and may b=secured at a desired position by a screw 83.

The gripping apparatus 316 has a movable retaining member 84 connected to and driven by the piston 86 of a cylinder 88. The retaining member 84 has a depending pin 90 extending through slot 80 of stationary member 70 and having a washer 92 received in the second slot 54 of plate 40. The retaining member 84 has a pair of screws 94 and 96 which fixedly secure rearward ends of the resilient nipper 42 and resilient guide 44 to the retaining member 84. The retaining member 84 has a forwardly directed flange 98 having a threaded aperture 100 to receive a screw 102 containing a nut 104 above the flange 98. The outer end of screw 102 bears upon the nipper 42 to bias the nipper 42 toward the plate 40. The screw 102 and nut 104 are adjustable in flange 98, such that the screw 102 may exert an adjustable bias against nipper 42 to accommodate different diameter sizes of threads.

The nipper 42 has an elongated bar 105 connected to a forward end 106 having an outwardly directed finger 108, with the forward end 106 being located near or against the plate 40.

The guide 44 has a forward curved end portion 110 spaced from the finger 108 of the nipper 42 to define a space 112 between the nipper finger 108 and end portion 110 of the guide 44. An outer end 114 of the guide 44 is located above the bar 105 of the nipper 42. In the configuration shown, the guide 44 bears against the cam 82 which raises the end 114 of the guide 44 from the nipper 42 for a purpose which will be described below. When the nipper 42 and guide 44 are moved forwardly by the retaining member 84, as will be described below, the guide 44 becomes disengaged from the cam 82 causing the end 114 of resilient guide 44 to engage against the bar 105 of nipper 42 causing further bias of the nipper 42 against the plate 40.

Figure 9:
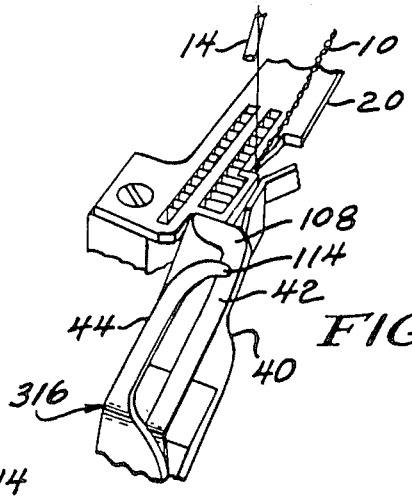

In operation, prior to severing the chain 10, the plate 40, nipper 42, and guide 44 are all located beneath the throat plate 20, as shown in FIG. 8, with the forward end of the nipper 42 located adjacent the forward end of the plate 40. With reference to FIGS. 6, 7, and 9, shortly before or after the chain 10 is severed, the cylinder 88 is activated causing forward movement of the retaining member 84 and retained nipper 42 and guide 44. At the same time, the pin 90 moves forwardly in the slot 80 of the stationary member 70, and the moving washer 92 permits forward movement of the spring biased plate 40 to a location with the beveled edge 46 located adjacent the throat plate 20. At this time, the screw 73 of stationary member 70 strikes the second end 52 of first slot 48 and the screw 75 of stationary member 70 strikes the second end 64 of third slot 60, thus preventing further forward movement of the plate 40 past the throat plate 20. However, with reference to FIGS. 6, 7, and 10, the cylinder 88 continues to drive the retaining member 84, thus moving the retained nipper 42 and guide 44 above the throat plate 20, while the pin 90 leaves the second end 58 of the second slot 54, since the plate 40 is no longer free to move forwardly past the throat plate 20.

Figure 10:
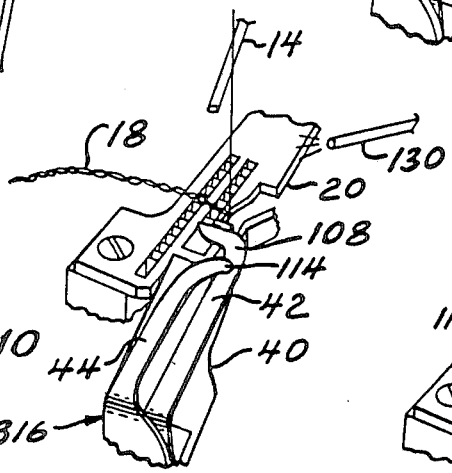
Figure 11:
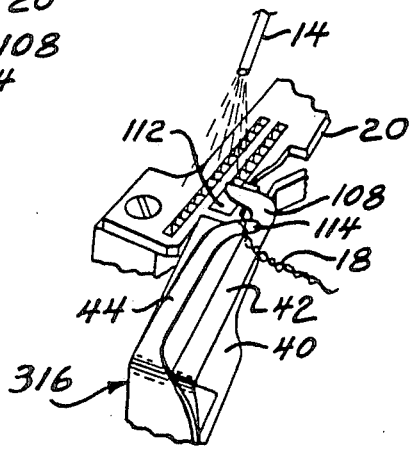

In this configuration of the gripping apparatus 16, the severed chain 18 is first moved to one side of the needle by a first blower 130, as shown in FIG. 10, and is then moved by the blower 14 into the space 112 between the nipper 42 and guide 44, with the curved guide 44 directing the chain 18 into the space 112, as shown in FIG. 11.

At this time, the cylinder 88 begins to retract the nipper 42 and guide 44 until the forward end of the nipper 42 is located adjacent the forward end of the plate 40 at the level of the throat plate 20. The severed chain 18 thus becomes caught between the finger 108 of the nipper 42 and the forward portion of the plate 40. Also, at this time, the washer 92 again engages against the second end 58 of second slot 54, and further retraction of the retaining member 84 also causes retraction of the plate 40 along with the nipper 42 and guide 44.

As previously discussed, when the guide 44 leaves the cam 82, the outer end 114 of the guide 44 is biased against the nipper 42 to apply an increased bias to the nipper 42 against the plate 40 in order to draw the chain 18 taut as the nipper 42 and guide 44 move beneath the throat plate 20.

Figure 12:
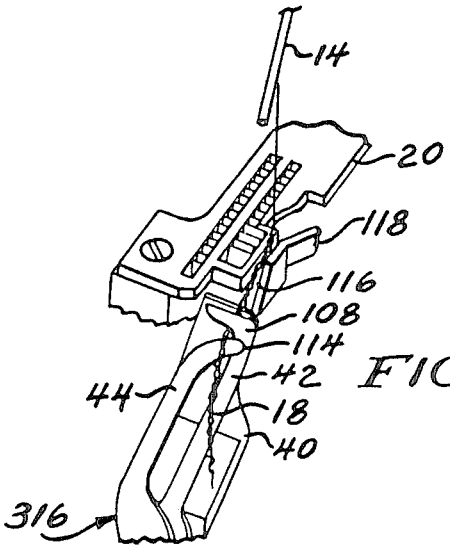

The cylinder continues to retract the nipper 42 and guide 44 beneath the throat plate 20, while driving the plate 40 through pin 90 to the configuration shown in FIG. 12 with the gripping apparatus 16 beneath the throat plate 20, with the chain 18 located in a groove 116 between the throat plate 20 and a conventional fabric cutter 118, and with the plate 40 striking the stop 78. At this time, the guide 44 engages the cam 82, and the end 114 of guide 44 becomes disengaged from the nipper 42 to provide a lessened bias between the nipper 42 and plate 40 Although the chain 18 is drawn taut beneath the top of throat plate 20, the lessened bias of the nipper 42 permits easy removal of the chain 18 from the nipper 42 and plate 40 to prevent distortion of the first few stitches of the next sewn fabric As previously discussed, the chain 18 is released from the gripping apparatus as the next fabric is sewn over the chain resulting in the sewn fabric of FIG. 13.

Another embodiment according to the present invention is shown in FIGS. 15–19, in which like reference numerals designate like parts. In this embodiment, the sewing machine may have a cutter, such as the cutter 13 described in connection with FIGS. 1–5, to sever the chain of stitches between two pieces of material. In this embodiment, the sewing machine has a throat plate 150, a feed dog 152, a conventional cutting device 154 having an upper cutting edge 156 and a lower cutting edge 158, and a forward notch 160 in the throat plate 150 located intermediate the feed dog 152 and cutting device 154. As known to the art, the cutting device 154 has an upper blade defining the upper cutting edge 156, with the upper blade being driven by a crankshaft of the sewing maching, and providing one stroke per each needle penetration. The upper blade moves in an up and down direction against a lower knife defining the lower cutting edge 158, and trims an edge of the material. The throat plate 150 has a rearwardly directed stitch tongue 162, and a presser foot 164 located adjacent the stitch tongue 162. As shown in FIG. 19, the presser foot 164 has a blower 166 which is directed toward the stitch tongue 162.

The sewing machine has a slot 168 to which vacuum is applied, a tube 170 leading to a first blower 172, and a second blower 174. The throat plate 150 has a reflecting surface 176, and a photosensor 178 located above the surface 176 to determine when fabric passes past the photosensor 178.

The sewing machine also has a grasping device, as shown in FIGS. 15 and 16, substantially as previously described having an elongated lower plate 340, an elongated nipper 342, and an elongated guide 344. The grasping device also has a cylinder 180 disposed below the lower plate 340 having a piston 182. When the cylinder 180 is actuated, the piston 182 is received through an opening 184 of the lower plate 340, and engages against the lower surface of the nipper 342 to move the nipper 42 away from the lower plate 340. The grasping device has a third blower 186 directed toward the space between the nipper 342 and guide 344.

In operation, after a piece of fabric has been sewn a chain of stitches is formed in the trailing edge of the fabric and the stitch tongue 162, as will be further described below. Next, the chain of stitches which is loosely formed on the stitch tongue 162 is blown off the stitch tongue 162 by the blower 166 on the presser foot 164, and the chain of stitches is captured in the vacuum slot 168. The chain of stitches is released by the vacuum slot 168, and the first and second blowers 172 and 174 move the chain of stitches forwardly of the needle where the chain is grasped between the nipper 342 and lower plate 340, as previously described and shown in FIG. 15, while the chain is retained in the notch 160 intermediate the feed dog 152 and cutting device 154.

When a subsequent piece of fabric is being sewn, the machine counts stitches in the fabric, such as 10 to 12, and the cylinder 180 is then actuated to move the nipper 342 away from the lower plate 340, and release the chain of stitches. At the same time, the third blower 186 is actuated to move the chain of stitches in the path of the cutting device 154, as shown in Fig. 16, and the chain is then cut by the cutting device 154 as the fabric moves past the needle. With reference to FIG. 14, this operation results in a shorter chain 18 sewn into the fabric to provide a neater appearance of the fabric.

With reference to FIG. 20, the sewing machine has a tensioning device 188 and a conventional stitch forming instrumentality 190 cooperating with the embodiment of FIGS. 15 through 19 to form an overedge stitch of Federal Specification 504-ssa-1. As known, the stitch forming instrumentality comprises an upper looper thread eyelet 192, an auxiliary looper thread eyelet 194, a lower looper thread eyelet 196, a fabric guard bracket 198, a frame looper thread guide 200, a presser arm 202, a looper thread pull-off 204, a needle thread cam pull-off 206, a needle thread eyelet 208, a top cover needle thread eyelet 210, an upper looper thread tube assembly 212, a needle 214, an upper looper 216, and a lower looper 218 which cooperate in a known manner to form the overedge stitch.

The tensioning device 188 has first tensioning means 20, second tensioning means 222, third tensioning means 224, fourth tensioning means 226, fifth tensioning means 228, and sixth tensioning means 230. The first tensioning means 220 is of conventional nature and applies a constant tension to a first thread 232. The second tensioning means 222 is of conventional nature and applies a constant tension to a second thread 234. The third tensioning means 224 is of conventional nature and applies a constant tension to a third thread 236.

The fourth, fifth, and sixth tensioning means 226, 228, and 230 are of the type illustrated in FIG. 21, and will be described in connection with the tensioning means 226. The tensioning means 226 has a lower plate 238, and an upper plate 240 biased by a helical spring 242 against the lower plate 238. The thread 232 passes between the plates 238 and 240, and the plates normally apply tension to the first thread 232. However, the tensioning means 226 has a cylinder 244 with a piston 246 which engages against the upper plate 240 and releases tension on the thread 232 when the cylinder 244 is actuated. The fifth and sixth tensioning means 228 and 230 operate in the same manner. The first, second, and third threads 232, 234, and 236 are connected to the stitch forming instrumentality 190, as shown in the drawing.

During seaming of the fabric and forming an overedge stitch, the fourth and sixth tensioning means 226 and 230 are actuated to release tension on the first and third threads 232 and 236, while the fifth tensioning means 228 applies tension to the second thread 234 to result in the overedge stitch pattern shown in FIG. 22. The sensor 178 indicates when the trailing edge of the fabric passes the sensor 178, and results in the following changes in the tensioning device 188. The fifth tensioning means 228 is actuated to release tension on the second thread 234, while the fourth and sixth tensioning means 226 and 230 apply tension to the first and third threads 232 and 236 resulting in the formation of a chain of stitches, as shown in FIG. 23, on the trailing edge of the fabric. Also, the chain of stitches are loosely formed on the stitch tongue 162 of the throat plate 150 in order that the blower 166 on the presser foot 164 may easily blow the chain off the stitch tongue 162.

The foregoing detailed description is given for clearness of understanding only, and no unnecessary limitations should be understood therefrom, as modifications will be obvious to those skilled in the art.

What is claimed is:

1. An apparatus for positioning a chain of stitches for stitching onto material in a sewing machine having a needle and a throat plate, comprising:

a cutting device;

means for positioning the chain of stitches forwardly of the needle;

means for grasping the chain in the forward position;

means for releasing the chain from the grasping means; and means for placing the chain in the path of the cutting device, wherein the grasping means comprises an elongated lower plate, an elongated nipper having a finger, and an elongated guide having an end portion defining a space between the end portion and finger.

2. The apparatus of claim 1 wherein the releasing means comprises means for moving the nipper away from the plate.

3. The apparatus of claim 2 wherein the moving means comprises a cylinder having a piston received through the plate to selectively engage against the nipper.

4. An apparatus for positioning a chain of stitches for stitching onto material having a needle and a throat plate, comprising:

a cutting device;

means for positioning the chain of stitches forwardly of the needle;

an elongated lower plate;

an elongated nipper having a finger;

an elongated guide having an end portion defining a space between the end portion and finger;

a cylinder having a piston received through the plate to selectively move the nipper away from the plate; and a blower directed to blow the chain in the path of the cutting device.

* * * * *